United States Patent [19]

Baburin et al.

[11] 4,051,576

[45] Oct. 4, 1977

[54] APPARATUS FOR AERODYNAMICALLY FORMING A FIBROUS SHEET MATERIAL

[76] Inventors: Sergei Vyacheslavovich Baburin, poselok Pravdinsky, ulitsa Zhdanova, 19, kv. 26, Moskovskaya oblast, Pushkinsky raion; Vasily Ivanovich Akimov, "Serebryanka", 9, kv. 69, Pushkino Moskovskoi oblasti, mikroraion; Vladimir Alexandrovich Gorbushin, Turisticheskaya uiltsa 13, kv. 19, Khotkovo Moskovskoi oblasti; Alexandr Petrovich Muraviev; Nepein Valery Nikolaevich, both of poselok Pravdinsky, Institutsky proezd, 1, Moskovskaya oblast, Pushkinsky raion; Mikhail Vladimirovich Frolov, Varshavskoe shosse, 16, kv. 235, Moscow; Sergei Arnoldovich Aizenberg, ulitsa Dmitrova, 11/67, kv. 136, Leningrad; Evgeny Mikhailovich Golovko, Krasnoputilovskaya ulitsa 28/29, kv. 58, Leningrad; Alexandr Fedorovich Kamenev, Bukharestskaya ulitsa 7, kv. 232, Leningrad; Igor Alexandrovich Sergeev, prospekt Stachek, 27, kv. 8, Leningrad, all of U.S.S.R.

[21] Appl. No.: 642,120

[22] Filed: Dec. 18, 1975

[51] Int. Cl.[2] ..... D04H 1/00

[52] U.S. Cl. ..... 19/156

[58] Field of Search ..... 19/155, 156–156.4; 425/80–83; 156/62.2, 62.4, 62.6

[56] References Cited

U.S. PATENT DOCUMENTS

| | | | |
|---|---|---|---|
| 3,766,607 | 10/1973 | Jende et al. | 19/156.3 |
| 3,886,629 | 6/1975 | Nakai et al. | 19/156.3 |

FOREIGN PATENT DOCUMENTS

| | | | |
|---|---|---|---|
| 1,224,325 | 3/1971 | United Kingdom | 19/156.3 |

*Primary Examiner*—Dorsey Newton
*Attorney, Agent, or Firm*—Robert E. Burns; Emmanuel J. Lobato; Bruce L. Adams

[57] ABSTRACT

An apparatus for making sheets of fibrous material in a chamber having perforated top and side inner walls into which an air stream mixture with fibers therein is introduced through a nozzle over a travelling screen conveyor on which the fibers are settled to form a mat thereon. The chamber has solid outer walls defining a space over the chamber and on the sides thereof into which air under pressure is introduced to keep the fibers in the chamber from contacting the inner walls and becoming electrostatically charged. The apparatus is provided with mechanism for applying a vacuum through the air-permeable conveyor to settle the fibers thereon and for forming a sheet of fibrous material thereon.

3 Claims, 8 Drawing Figures

APPARATUS FOR AERODYNAMICALLY FORMING A FIBROUS SHEET MATERIAL

BACKGROUND OF THE INVENTION

The present invention relates to an apparatus for forming fibrous sheet material, and more particularly it relates to an apparatus for aerodynamically forming a fibrous sheet material, e.g. paper, cardboard, non-woven materials, and can be utilized in the pulp-and-paper, textile and construction material industries, in plants forming fibrous materials.

At present, there are known apparatus for aerodynamically forming a fibrous sheet material, including means for continuously and uniformly distributing fibres in a stream of an air-material mixture made up by the fibres and a gas having for its components air and particles or droplets of moisture, the means communicating with a forming chamber. The forming chamber includes walls and a perforated bottom in the form of an endless conveyor running over driven rolls. A device for sucking-in the gas from the air-material mixture, as the latter settles on the bottom of the forming chamber, underlies the conveyor (see U.S.S.R Pat. No. 222,299, Int. Cl. D 21 j 3/12). As the moving stream of the fibres in the air-material mixture contacts the walls of the forming chamber, the fibres become electrostatically charged, which results in their aggregation into flocks. The higher the speed of the motion of the fibres of the air-material mixture in the forming chamber, i.e. the higher the speed of formation of the fibrous material and the higher the productivity of the apparatus, the flocking action becomes correspondingly more pronounced. Consequently, the known apparatus fails to ensure a high degree of uniformity of the distribution of the fibres in the final sheet of the fibrous material, which effects the quality of the latter.

SUMMARY OF THE INVENTION

It is the main object of the present invention to create and apparatus for forming aerodynamically a fibrous material, which should essentially eliminate the possibility of the fibres of the air-material mixture becoming electrostatically charged and aggregating into flocks.

It is another object of the present invention to create an apparatus for aerodynamically forming a fibrous sheet material, which should provide for a high speed of forming the fibrous sheet material and, hence, for the increased productivity of the material-making plant including the apparatus.

It is yet another object of the present invention to improve the quality of the fibrous sheet material formed by the apparatus.

These and other objects are attained in an apparatus for forming aerodynamically a fibrous sheet material by depositing the fibres from a stream of an air-material mixture including the fibres and a gas, the apparatus comprising a forming chamber of which the bottom is formed by a movable formations conveyor, means for introducing said mixture into the chamber, effecting uniform distribution of the fibres in the stream of the air-material mixture, and means for sucking-in the gas from the air-material mixture, as the fibres settle on the net of the forming chamber, for forming a fibrous sheet on this conveyor, in which apparatus, in accordance with the present invention, the walls of the chamber are internally hollow, their surface, facing the interior of the chamber being perforated, the internal space of these hollow walls communicating with means for continuously supplying a gas thereinto, the gas flowing through the perforations into the chamber, so that the gas issuing from the perforations prevents settling of the fibres on the internal surface of the wall of the chamber. The gas supplying means are preferably in the form of a branch pipe mounted externally of the chamber, directly on the wall thereof.

The essence of the present invention is, as follows.

To create the conditions ensuring a uniform motion of the air-material flow along the forming chamber and to preclude electrostatic charging of the fibres with subsequent formation of flocks, there is supplied through the branch pipe mounted externally of the chamber on the wall thereof a gas including the components of air, the gas being uniformly distributed in the internal space of the hollow walls and flowing into the chamber through the perforations made in the surface of the wall facing the interior of the chamber, thus driving the flow of the air-material mixture, moving through the chamber, from the walls of the latter and compensating for the outgoing air taken by the suction device from the air-material mixture.

BRIEF DESCRIPTION OF THE DRAWING

Other objects and advantages of the present invention will be made apparent in the detailed description of an embodiment of the apparatus for aerodynamically forming a fibrous sheet material, to follow hereinbelow, with reference being had to the accompanying drawings, wherein.

DESCRIPTION OF THE PREFERRED EMBODIMENT

Figure 1:
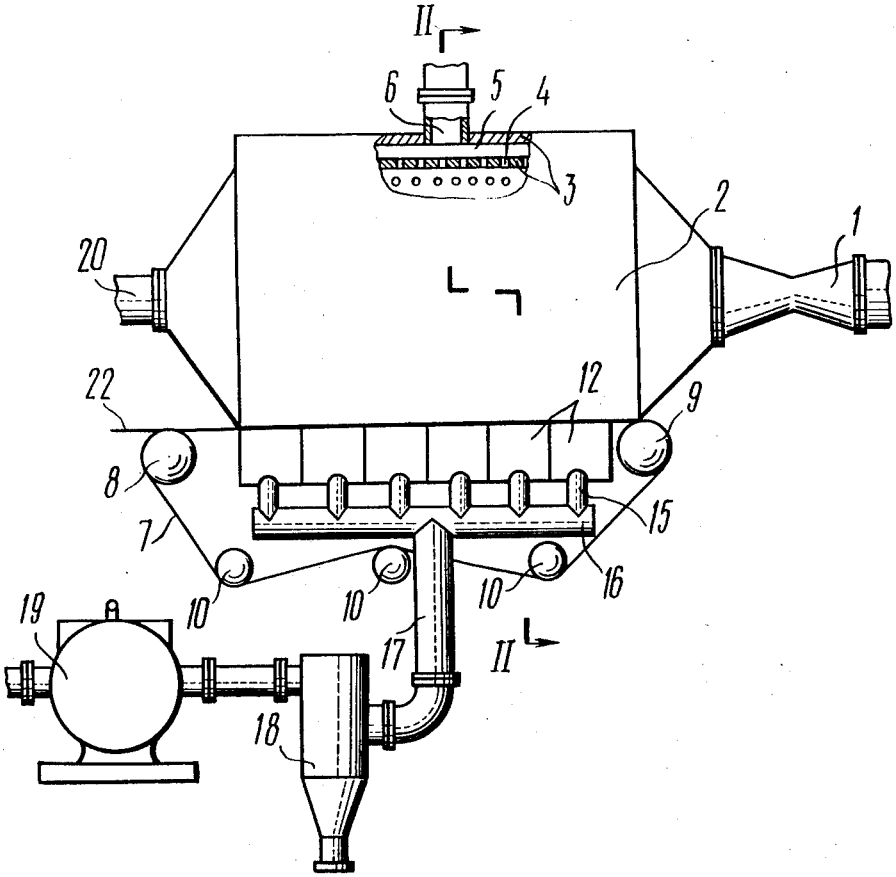
FIG. 1 schematically illustrates an apparatus for aerodynamically forming a fibrous sheet material according to the invention and is partially broken away at a pressure connection thereto.

In the drawings, the apparatus includes an inlet nozzle 1 for feeding-in the air-material mixture made up by fibres and a gas including the components of air and particles or droplets of moisture, the mixture being directed into a forming chamber 2. The nozzle for feeding-in the air-material mixture may be made in the form of a slit-aperture nozzle fast with the face end of the forming chamber 2. The forming chamber 2 has hollow walls 3 defining the rectangular interior of the chamber. The surface of the walls 3, facing the interior of the chamber 2, has perforations 4 uniformly distributed over the entire area of the surface of the walls, the perforations being of any suitable shape, e.g. elongated, spheroidal or round.

There is mounted externally of the chamber, directly on its wall 3 a gas supplying means, the gas having the components of air, the gas supplying means communicating with the internal space 5 of the walls 3. The means for supplying the gas may be in the form of a pipe 6. The bottom of the forming chamber is defined by a travelling endless flat metal screen or foraminous conveyor 7, running over a driving shaft 8, a driven shaft 9 and tensioning rolls 10 mounted on supports 11 (FIG. 2).

Figure 2:
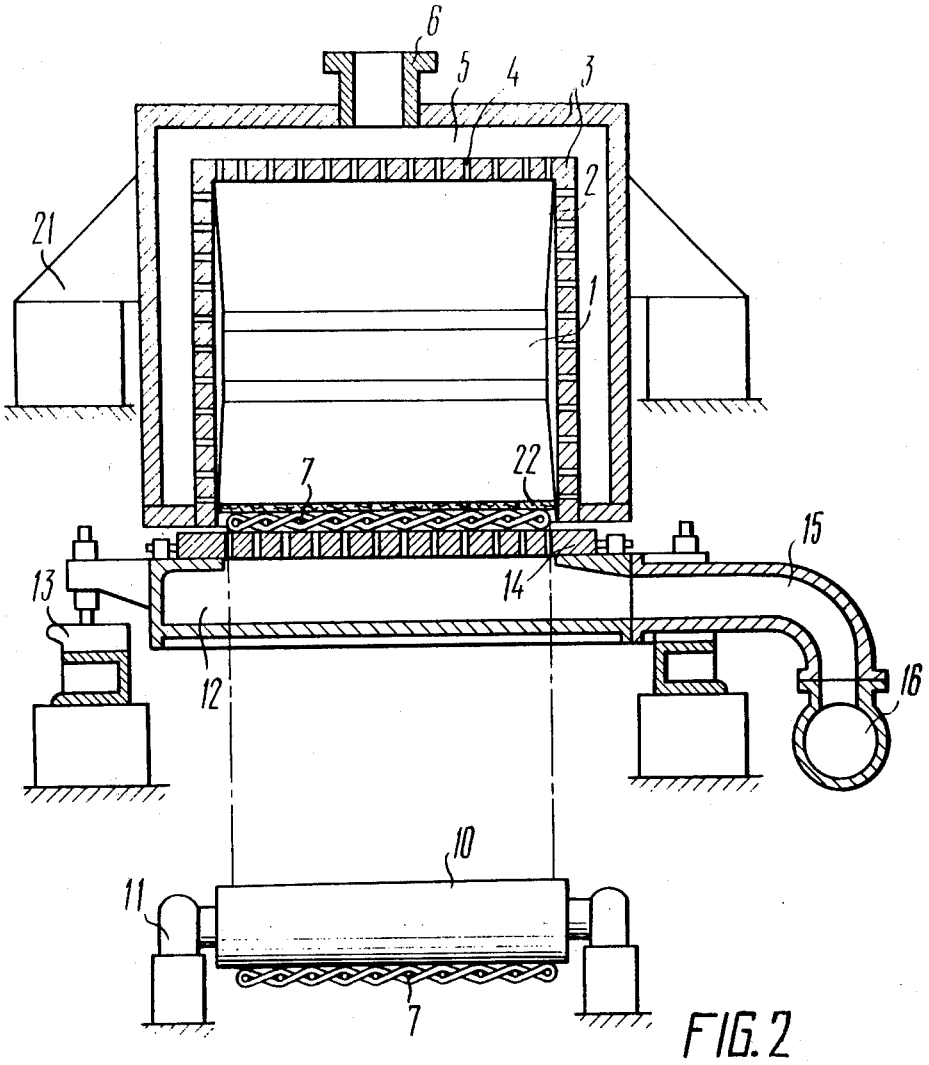
FIG. 2 is a section view along section line II—II of FIG. 1.

A suction device underlies the travelling the screen conveyor 7, including suction boxes 12 mounted on supports 13 (FIG. 2). The tops of the suction boxes are in the form of lids 14 which are apertured for the passage of the gas. The suction boxes 12 are provided with connections 15 through which the gas sucked-in gas exits from the apparatus. The connections 15 are connected through a manifold 16 to a main suction line 17. The latter communicates via a cyclone 18 including a cylindrical vessel with a conical bottom, incorporated to separate the solid particles and moisture from the gas, with a vacuum pump 19 which may be any suitable known vacuum pump capable of producing a suction of 0.02–0.03 atm. abs. To take away the fibres that have not settled on the conveyor 7 of the forming chamber, there is provided a pipe 20 fast with the wall 3 of the chamber, in opposition to the wall supporting the nozzle for introducing the air-material mixture into the chamber.

The apparatus operates, as follows.

To effect aerodynamic forming of the fibrous sheet material, the flow of the air-material mixture made up by the fibres and the gas under a gauge pressure is continuously and uniformly supplied through the nozzle 1 in the form of the slit-aperture nozzle into the forming chamber 2 (FIG. 2) mounted on supports 21, through the face end of this chamber. The pressure inside the chamber 2 is nearly atmospheric. Simultaneously, a gas is supplied into the internal space 5 of the hollow walls 3 of the forming chamber 2 by the gas supplying means including the inlet pipe 6, the gas becoming uniformly distributed in the space 3 within the walls 3, the gas having the components of air. The surface of the walls 3 facing the interior of the chamber 2 having the perforations 4 therethrough, the gas issues through these perforations 4 into the forming chamber 2, driving away from the surface of the walls 3 the flow of the air-material mixture advancing in the forming chamber substantially perpendicularly to the direction in which the gas issues from the perforations 4. With the forming chamber constructed in the herein disclosed manner, the fibres would not settle on the internal surface of the walls 3, would not become electrostatically charged and would not aggregate into flakes and flocks.

The suction created by the vacuum pump 19 in the suction boxes 12 underlying the conveyor 7 (the latter running over the driving shaft 8, the driven shaft 9 and the tensioning rolls 10) makes the fibres from the air-material flow settle on the conveyor 7, forming a web or lap of the fibrous sheet material. The fibres that have not settled on the bolt 7 of the forming chamber are withdrawn from the latter through the exit pipe 20 fast with the wall 3 of the chamber 2, opposite to the wall supporting the means 1 for introducing the air-material mixture into the chamber. The fibres withdrawn via the branch pipe 20 are insert recirculated.

The gas, solids and the moisture particles which are withdrawn from the air-material mixture through the lap of the fibres, that has been deposited on the screen conveyor 7, advance into the suction boxes 12 where-from they flow through the connections 15 into the manifold pipe 16. From the latter the abovesaid components are directed into the main pipe 17 which guides them into the cyclone 18 where they are separated and the gas is recirculated.

The formed sheet material 22 is transported away from the forming chamber 2 and directed for further treatment, i.e. compression, drying and finishing.

As it can be seen from the above disclosure, in the herein proposed apparatus for aerodynamically forming a fibrous sheet material, there is precluded the friction of the fibres against the internal surface of the walls of the forming chamber, which prevents electrostatic charging of the fibres and their aggregating into flocks. Consequently, the apparatus is capable of producing a fibrous sheet material of a high quality, and that at a high productivity.

It must be understood that those competent in the art may introduce various modifications into the apparatus for aerodynamically forming a fibrous sheet material, which has been described hereinabove for purely illustrative purposes, without departing from the spirit and scope of the invention, as defined in the claims to follow.

What we claim is:

1. An apparatus for making sheets of fibrous material comparising: a forming chamber having perforated inner walls on top and on two opposite sides and solid outer walls spaced from said inner walls and defining a space therebetween for receiving a gas under pressure, means for supplying said gas under pressure into said space for entry into said chamber through the perforations in the inner walls to maintain the fibers from contacting said inner walls of said chamber during operation, a bottom wall of said forming chamber comprising an endless air-permeable travelling conveyor extending along the entire length thereof, means for feeding an air stream mixture with fibers into the interior of said forming chamber and flowed between said two opposite sides, means for applying an air suction through said conveyor to settle fibers thereon in the form of a sheet material, and a means for removing fibers from said chamber that have not settled on said conveyor.

2. The apparatus for making sheets of fibrous material as claimed in claim 1, wherein the means for feeding an air mixture with fibers comprises a nozzle hermetically connected to an end portion of the forming chamber through a funnel.

3. The apparatus for making sheets of fibrous material as claimed in claim 1, wherein said means for removing the fibers that have not settled on the endless air-permeable travelling conveyor comprises a branch pipe hermetically connected to a rear end portion of the forming chamber through a funnel.

* * * * *